US008333027B1

(12) United States Patent
Vosbikian et al.

(10) Patent No.: US 8,333,027 B1
(45) Date of Patent: Dec. 18, 2012

(54) INTERCHANGEABLE ADDRESS SIGNAGE SYSTEM

(75) Inventors: Peter S. Vosbikian, Moorestown, NJ (US); Robert Petner, Burlington, NJ (US)

(73) Assignee: Zenith Innovation, LLC, Delran, NJ (US)

( * ) Notice: Subject to any disclaimer, the term of this patent is extended or adjusted under 35 U.S.C. 154(b) by 0 days.

(21) Appl. No.: 13/543,994

(22) Filed: Jul. 9, 2012

(51) Int. Cl.
*G09F 7/02* (2006.01)

(52) U.S. Cl. ..... 40/618; 40/612

(58) Field of Classification Search ..... 40/612, 40/618, 611.08
See application file for complete search history.

(56) References Cited

U.S. PATENT DOCUMENTS 1,258,146 A * 3/1918 Russell ..... 40/618
2,058,168 A * 10/1936 Merk ..... 40/653
2,967,366 A * 1/1961 Colbert ..... 40/618
3,079,714 A * 3/1963 Zeigler et al. ..... 40/618
4,884,351 A * 12/1989 Abramson ..... 40/611.05
7,428,793 B2 * 9/2008 Dwyer ..... 40/596

* cited by examiner

*Primary Examiner* — Gary Hoge
(74) *Attorney, Agent, or Firm* — Stuart M. Goldstein

(57) ABSTRACT

An interchangeable address signage system utilizes one or more address tiles retained on a backplate. The backplate has a top rail and a bottom rail, with tabs extending from the rails. The address tiles each notches on their top surfaces and their bottom surfaces which correspond to the tabs on the rails of the backplate. The address tiles are either retained between the tabs extending from the rails or by the positioning of the tabs within the notches of the address tiles, depending on the number of tiles being placed on the backplate. A separable support frame attached to the backplate maintains the backplate and tiles in position. A display member which extends from the support frame provides for interchangeable decorative displays to be attached to the system.

5 Claims, 5 Drawing Sheets

INTERCHANGEABLE ADDRESS SIGNAGE SYSTEM

BACKGROUND OF THE INVENTION

Address signs, especially those which are also decorative in nature, are very popular, not only for residential homes, but for commercial buildings as well. However, in order to obtain a professional looking and attractive sign, the home or building owner must usually incur the expense of a custom made sign or a costly off-the-shelf one. And such signs have limited value if the owner moves or wishes to change the sign's design. The alternative is to purchase an inexpensive, generally cheap looking sign, on which the owner must unscientifically attach numbers, usually by adhesive backed number stickers. This routinely results in the numbers being crooked or off centered. These number stickers also generally cannot be cleanly removed if numbers need to be replaced. Further, most such signs do not allow for readily replaceable, attractive, decorative design options.

SUMMARY OF THE INVENTION

It is thus the object of the present invention to provide an interchangeable address signage system which overcomes the disadvantages and limitations of prior address signage.

It is an object of the present invention to provide an interchangeable address signage system which provides for the placement and retention of numbered address tiles which, regardless of the number of address numbers, will be positioned straight and centered on the address sign.

It is another object of the present invention to provide an interchangeable address signage system which provides for the easy and simple replacement of address number tiles, if the address on the sign must be changed.

It is a further object of the present invention to provide an interchangeable address signage system in which address tiles showing the address on the sign are securely retained in place, but are easily removed if necessary.

It is still another object of the present invention to provide an interchangeable address signage system which provides for the simple and easy replacement of decorative signage.

It is another object of the present invention to provide an interchangeable address signage system which, when address tiles are retained and display signage is attached, provides a professional looking and most attractive address sign.

These and other objects are accomplished by the present invention, an interchangeable address signage system which utilizes one or more address tiles retained on a backplate. The backplate has a top rail and a bottom rail, with tabs extending from the rails. The address tiles each have notches on their top surfaces and their bottom surfaces which correspond to the tabs on the rails of the backplate. The address tiles are either retained between the tabs extending from the rails or by the positioning of the tabs within the notches of the address tiles, depending on the number of tiles being placed on the backplate. A separable support frame attached to the backplate maintains the backplate and tiles in position. A display member which extends from the support frame provides for interchangeable decorative displays to be attached to the system.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
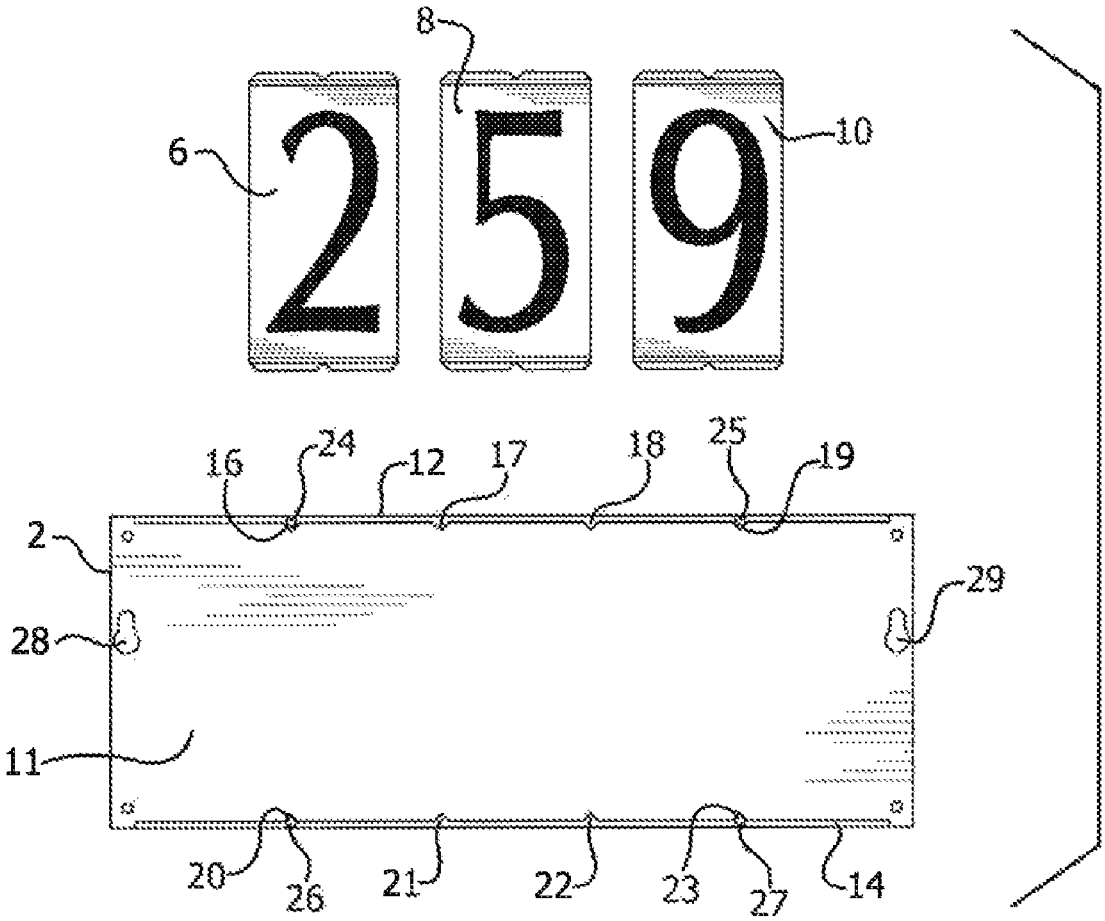
FIG. 1. is a front view of the backplate of the present invention, with exemplar address tiles of the invention to be mounted thereon.
Figure 2:
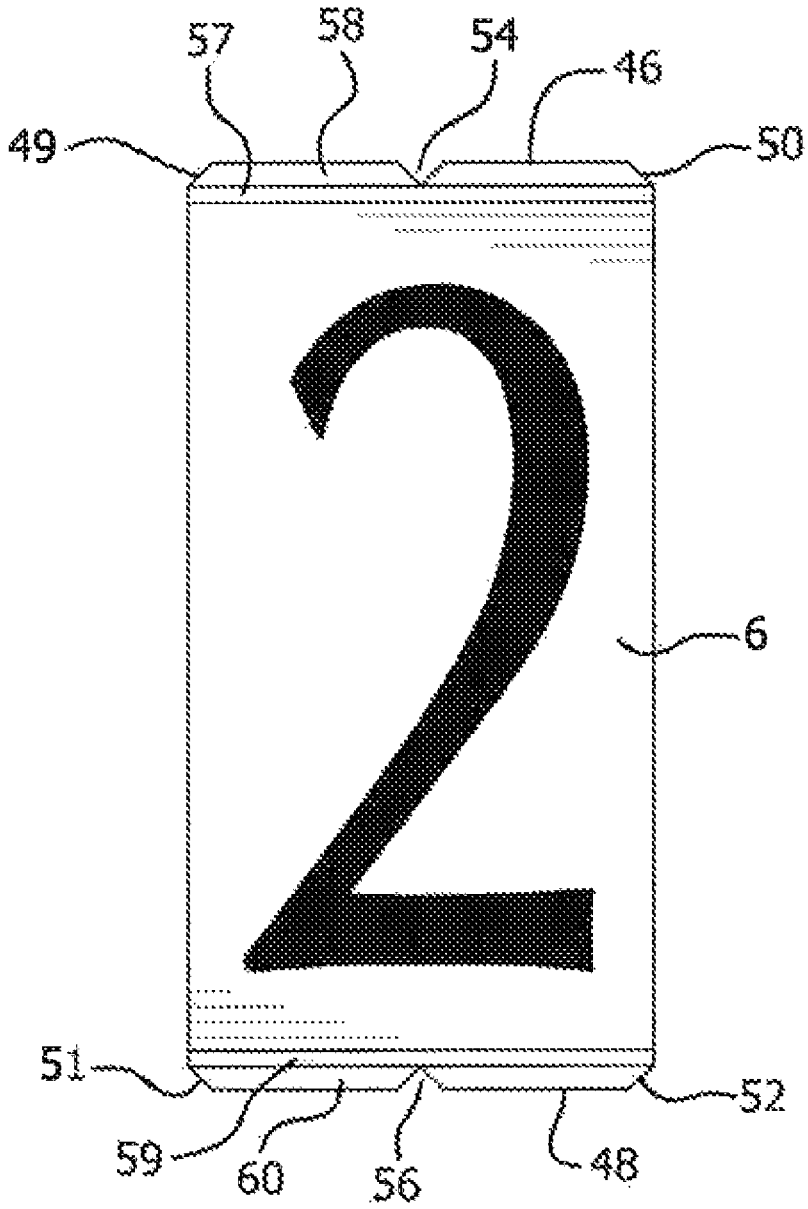
FIG. 2 is an enlarged view of an address tile of the present invention.

The interchangeable signage system of the present invention comprises backplate 2, support frame 4, separable from the backplate, and representative address tiles 6, 8, and 10.

Backplate 2 comprises front surface 11, top rail 12 and bottom rail 14. Tabs 16, 17, 18, and 19 extend downward from top rail 12 and tabs 20, 21, 22, and 23 extend upward from bottom rail 14. Pegs 24 and 25 extend outward from top rail 12 and pegs 26 and 27 extend outward from bottom rail 14. Holes 28 and 29 are provided for purposes of hanging backplate 2 and the entire assembled system.

Support frame 4 comprises center opening 30 circumscribed by horizontal and vertical framing components 31, 32, 33, and 34. Holes 35 and 36 are provided on the back side and over horizontal framing component 31, and holes 37 and 38 are provided on the backside and under horizontal framing component 33. Display member 40, extending up from framing component 31, comprises display section 42 which has Velcro® or equivalent attachment devices 44 for removeably securing different displays and signage on the surface of the display section.

Address tile 6, representative of the configuration of all the address tiles of the invention, comprises top surface 46, bottom surface 48, and angled corner surfaces 49 and 50 extending down from the top surface and corner surfaces 51 and 52 extending up from the bottom surface. Top surface 46 has inwardly extending notch 54 and bottom surface 48 has inwardly extending notch 56. Notches 54 and 56 are sized such that the tabs extending from top rail 12 and bottom rail 14 of backplate 2 fit precisely and snugly within the notches. Address tile 6, as with all the address tiles, also has upper address tile extension 58 above upper address tile rail 57 and lower address tile extension 60 below lower address tile rail 60.

The address tiles themselves can be fabricated a number of ways. They can be manufactured as completely formed units with numbers integrally molded or otherwise permanently extending from the face of each tile. The faces of the tiles could be provided with holes into which numbers with rearwardly extending pegs are removeably inserted. The numbers to be placed on the faces of the tiles could also be secured by adhesive, Velcro®, or other equivalent attachment means.

Figure 3:
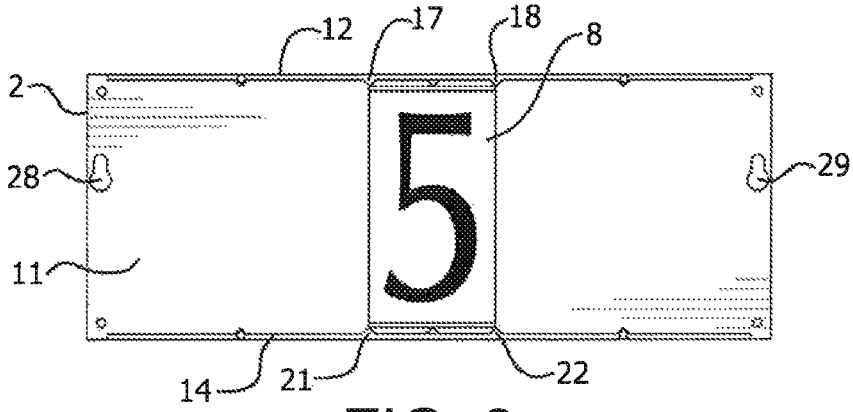
FIG. 3 is front view of the backplate of the present invention with one address tile of the invention mounted thereon.

The proper usage of the signage system of the present invention is easy and simple and results in the neat and centered alignment of any number of address numbers. In the embodiment shown, for addresses which have one or more odd number of numbers, the address tiles are placed in a first, "between tab" position on backplate 2, such that the angled corner surfaces of the tiles are flush with tabs extending from top rail 12 and bottom rail 14 of the backplate. For instance, FIG. 3 shows address tile 8 on front surface 11 of backplate 2, positioned between top rail 12 and bottom rail 14, and tabs 17 and 18 extending from the top rail, and tabs 21 and 22 extending from the bottom rail, the top and bottom surfaces and the angled corners of the tile being flush against the rails and the tabs. Address tile 8 is thus centered on backplate 2.

Figure 5:
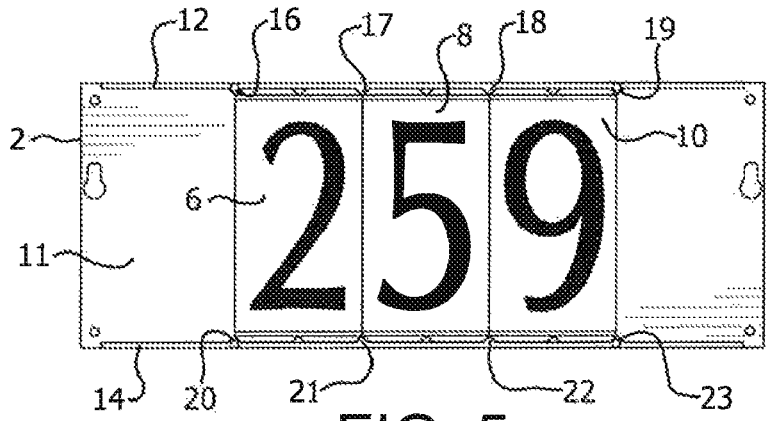
FIG. 5 is a front view of the backplate of the present invention with three address tiles of the invention mounted thereon.
Figure 6:
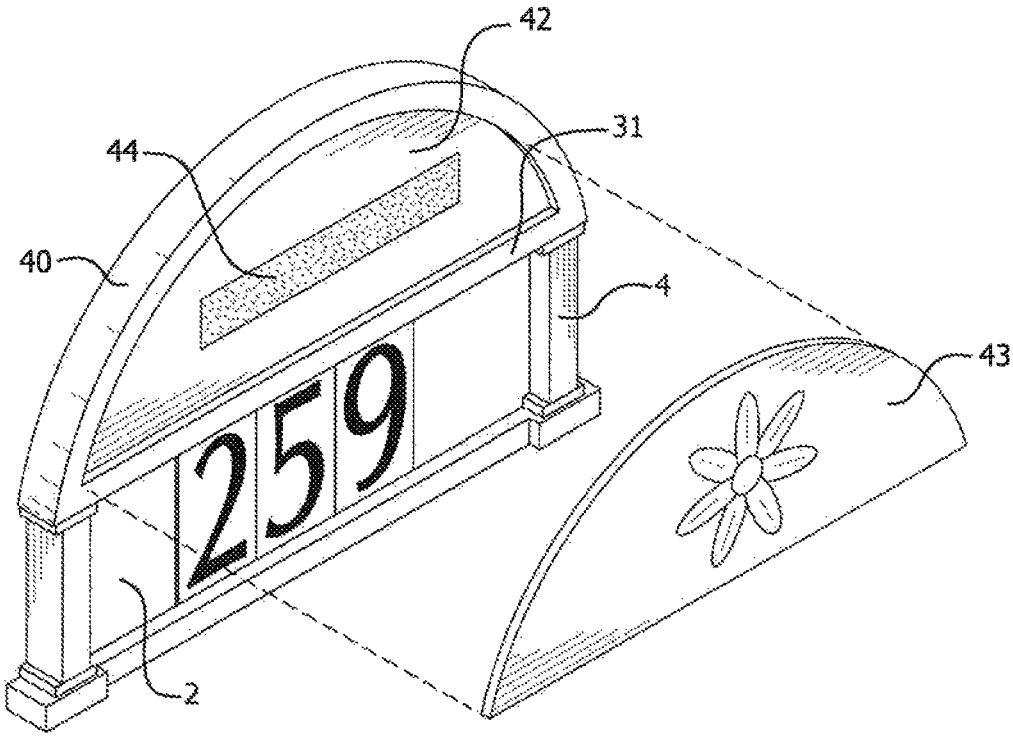
FIG. 6 is an exploded front isometric view of the backplate of the present invention, with address numbers and decorative art work of the invention.

Centering other odd numbers of tile is accomplished in similar fashion. For instance, three address tiles 6, 8, and 10, as shown in FIG. 5, are placed in the "between tab" position. The tiles are placed on front surface 11 of backplate 2, such that tile 6 is between top rail 12 and bottom rail 14, and tabs 16 and 17 extending from the top rail and between tabs 20 and 21 extending from the bottom rail; tile 8 is between the top and bottom rails, and tabs 17 and 18 extending from the top rail and between tabs 21 and 22 extending from the bottom rail; and tile 10 is between the top and bottom rails, and tabs 21 and 22 extending from the top rail, and tabs 22 and 23 extending from the bottom rail. Address tiles 6, 8, and 10 are thus centered on backplate 2.

Figure 4:
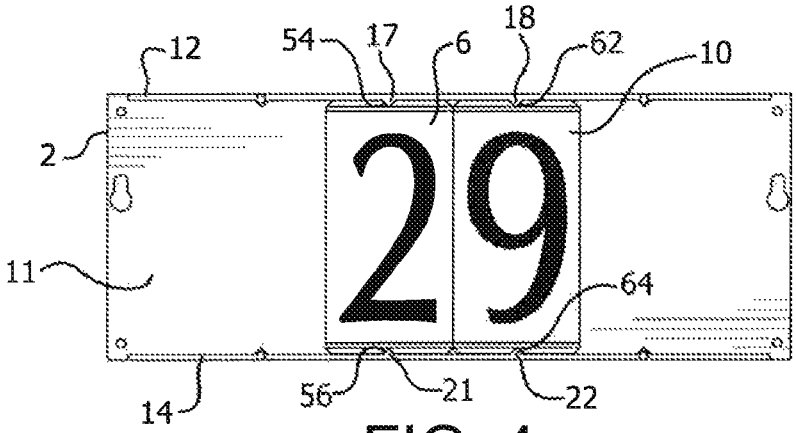
FIG. 4 is a front view of the backplate of the present invention with two address tiles of the invention mounted thereon.

In the embodiment shown, for address which have two or an even of numbers, the address tiles are placed in a second, "tab in" notch position on backplate 2, such that the notches of the tiles are fitted within the tabs extending from top rail 12 and bottom rail 14 of the backplate. For instance, FIG. 4 shows address tile 6 on front surface 11 of backplate 2, positioned between top rail 12 and bottom rail 14, with tab 17 of the top rail extending into notch 54 of the tile and tab 21 extending from the bottom rail, fitted within notch 56 of the address tile. Address tile 10 on front surface 11 of backplate 2, is positioned between top rail 12 and bottom rail 14, tab 18 extending from the top rail is fitted within notch 62 of the address tile and tab 22 extending from bottom rail 14 is fitted within notch 64 of the address tile. Address tile 6 and 8 are thus centered on backplate 2.

Centering four address tiles is also accomplished by placing the tiles in the "tab in" notch position, as is easily understood from the above referenced description.

The back plate embodiments shown in FIGS. 3-5 allow for five address tiles, and thus addresses of one, three or five numbers. However, the invention is not so restricted to the length of backplate 2 with its accompanying rails and notches, as shown. The back plate can be lengthened if more address tiles are required for larger odd-numbered addresses. Similarly, the embodiments allow for centered placement of four address tiles, for addresses of two or four numbers. The number of even tiles is also not so restricted. The length of backplate 2, with its accompanying rails and notches, can be extended if more address tiles are required for larger, even-numbered addresses.

The invention is further not to be deemed restricted to utilizing the "between tab" position for an odd number of tiles and the "tab in" notch position for an even number of tiles. The notches extending from rails 12 and 14 can be configured such that the odd number of tiles are in the tabs, i.e. the exact center of the rails would have a center notch such that one tile could be contained on back plate 2 in that notch, and three or five tiles would then be positionable in the other appropriately spaced notches. By the same token, an even number of tiles could be utilized between the tabs by similarly reconfiguring the tabs such that there is a center tab.

Figure 7:
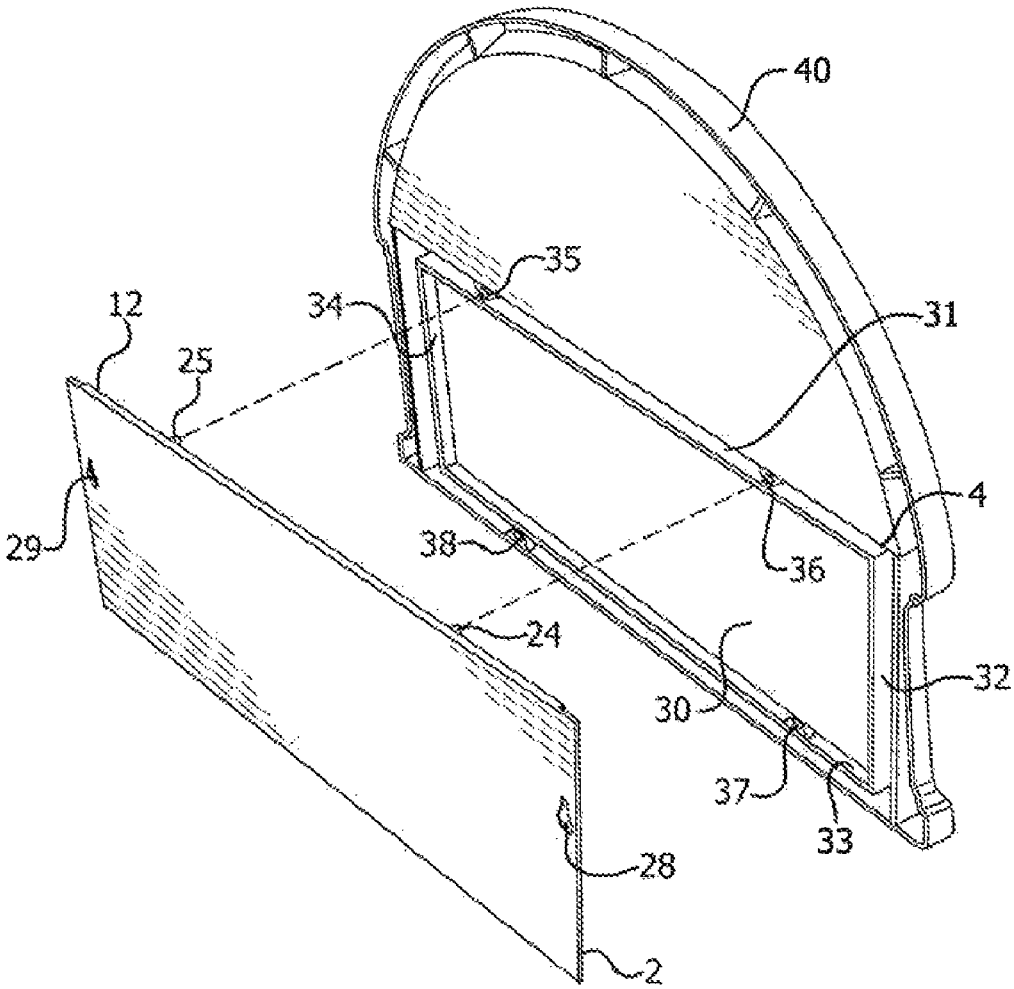
FIG. 7 is an exploded rear isometric view showing the backplate and support frame of the present invention.

Once the address tiles have been positioned on back plate 2, the back plate is positioned relative to support frame 4, as seen in FIG. 7, such that pegs 24, 25, 26, and 27 are aligned with holes 35, 36, 37, and 38 in the support frame. Back plate 2 is then connected to support frame 4 by insertion of its pegs into the support frame holes. This connection immoveably secures the address tiles in place, since the back edges of framing components 31 and 33 overlap the address tile extensions which are adjacent to the address tile rails, e.g. address tile extensions 58 above address tile rail 57 and address tile extension 60 below address tile rail 59 on address tile 6.

Display member 40, attached to and extending from support frame 4, has blank display section 42. Velcro® or equivalent attachment means 44 is provided on display section 42. Any number of different signage designs 43, e.g. flowers for Mother's Day, flags for Independence Day, hearts for Valentine's Day, balloons for birthdays, etc. can be attached to display section 42, via its attachment means. A given signage design is readily and easily removed and another substituted in its place.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. An interchangeable address signage system comprising:

a plurality of address tiles, each tile comprising a top surface, a bottom surface, and angled corner surfaces;

a backplate comprising a front surface, a top rail, a bottom rail, and tab means on the front surface for retaining one or more address tiles on the backplate in a first position whereby one or more address tiles are retained between the top and bottom rails and between the tab means, and for retaining one or more address tiles in a second position whereby address tiles are retained between the top and bottom rails and the tab means are fitted within the address tiles; and a support frame separable from the backplate and means to attach the backplate to the support frame comprising peg members on the top and bottom rails of the backplate and peg receptacles on the support frame which engage the peg members, whereby when the peg members and peg receptacles are engaged, said one or more address tiles are immoveably maintained on the backplate.

2. The address signage system as in claim 1 comprising a display member extending from the support frame, said display member having a display section.

3. The address signage system as in claim 2 further comprising means on the display section to secure signage to the display section.

4. An interchangeable address signage system comprising:

one or more address tiles, each tile comprising a top surface, a bottom surface, and angled corner surfaces extending down from the top surface and up from the bottom surface, the top and bottom surfaces each having inwardly extending notches;

a backplate comprising a front surface, the front surface supporting a top rail and a bottom rail and a series of spaced apart tabs extending from each rail, whereby one or more of the address tiles are configured to be placed on the front surface of the backplate such that the top surface of the address tile is flush with the top rail and the bottom surface of the tile is flush with the bottom rail and, in a first position, the corner surfaces of the tile are flush with one or more of the tabs extending from the top rail and one or more of the tabs extending from the bottom rail and, in a second position, the notches of the tile are fitted snugly within one tab of the top rail and one tab of the bottom.

5. The address signage system as in claim 4 further comprising a support frame separable from the backplate.

* * * * *